US006135856A

United States Patent [19]

Tjaden et al.

[11] Patent Number: 6,135,856

[45] Date of Patent: Oct. 24, 2000

[54] APPARATUS AND METHOD FOR SEMICONDUCTOR PLANARIZATION

[75] Inventors: Kevin Tjaden, Boise, Id.; G. Hugo Urbina, El Paso, Tex.

[73] Assignee: Micron Technology, Inc., Boise, Id.

[21] Appl. No.: 08/992,548

[22] Filed: Dec. 17, 1997

Related U.S. Application Data

[63] Continuation-in-part of application No. 08/588,734, Jan. 19, 1996, Pat. No. 5,899,799.

[51] Int. Cl.[7] ..... B24B 1/00; B24D 11/00

[52] U.S. Cl. ..... 451/37; 451/36; 451/41; 451/59; 451/288; 451/527; 451/530; 451/533; 451/550

[58] Field of Search ..... 216/88, 89; 438/692, 438/693; 451/36, 37, 41, 56, 59, 285, 287, 288, 527, 530, 533, 539, 550, 534

[56] References Cited

U.S. PATENT DOCUMENTS

| | | | |
|---|---|---|---|
| 3,128,580 | 4/1964 | Davis . | |
| 3,795,932 | 3/1974 | Young . | |
| 3,921,342 | 11/1975 | Day | 451/550 |
| 4,728,552 | 3/1988 | Jensen, Jr. . | |
| 4,811,443 | 3/1989 | Nishizawa . | |
| 4,841,680 | 6/1989 | Hoffstein et al. . | |
| 4,927,432 | 5/1990 | Budinger et al. . | |
| 4,959,113 | 9/1990 | Roberts . | |
| 5,177,908 | 1/1993 | Tuttle . | |
| 5,210,472 | 5/1993 | Casper . | |
| 5,212,910 | 5/1993 | Breivogel et al. | 451/539 X |
| 5,216,843 | 6/1993 | Breivogel et al. . | |
| 5,257,478 | 11/1993 | Hyde et al. . | |
| 5,264,010 | 11/1993 | Brancaleoni et al. . | |
| 5,382,272 | 1/1995 | Cook et al. . | |
| 5,389,352 | 2/1995 | Wang . | |
| 5,391,258 | 2/1995 | Brancaleoni et al. . | |
| 5,450,647 | 9/1995 | Dorsey . | |
| 5,601,474 | 2/1997 | Takahashi | 451/550 X |
| 5,888,121 | 3/1999 | Kirchner et al. | 451/41 |

FOREIGN PATENT DOCUMENTS

| | | |
|---|---|---|
| 356076382 | 6/1981 | Japan . |
| 403086467 | 4/1991 | Japan . |

*Primary Examiner*—Timothy V. Eley
*Attorney, Agent, or Firm*—Hale and Dorr LLP

[57] ABSTRACT

The disclosed polishing apparatus includes a lower pad and an upper pad. The upper pad is disposed over the lower pad and has an upper abrasive surface. The lower pad has an upper surface defining one or more grooves. When the upper pad is placed over the lower pad, channels may form in the upper pad abrasive surface over the grooves. These channels improve the distribution of slurry in the polishing apparatus. The upper pad may define a first polishing region and a second polishing region, the total area of channels in the first polishing region being greater than the total area of the channels in the second polishing region.

53 Claims, 7 Drawing Sheets

APPARATUS AND METHOD FOR SEMICONDUCTOR PLANARIZATION

REFERENCE TO RELATED APPLICATIONS

This application is a continuation-in-part of U.S. patent application Ser. No. 08/588,734, entitled METHOD AND SYSTEM TO INCREASE DELIVERY OF SLURRY TO THE SURFACE OF LARGE SUBSTRATES DURING POLISHING OPERATIONS, filed on Jan. 19, 1996, now U.S. Pat. No. 5,899,799 in the name of Kevin Tjaden, and assigned to the assignee of the present invention.

The present invention was made with Government support under Contract No. DABT63-93-C-0025 awarded by the Advanced Research Projects Agency (ARPA). The Government has certain rights in the invention.

BACKGROUND OF THE INVENTION

The present invention relates to an improved polishing apparatus. More specifically, the present invention relates to an improved apparatus for providing chemical-mechanical-planarization (CMP) to relatively large surfaces.

Various polishing pads for providing CMP to semiconductor surfaces are known and are described, for example, in U.S. Pat. Nos. 4,841,680; 4,927,432; and 4,728,552. Various slurries for use in providing CMP are also known and are described, for example, in U.S. Pat. Nos. 4,959,113; 5,264,010; 5,382,272; 389,352; and 5,391,258.

FIG. 1A shows a top view of a prior art polishing apparatus 100. FIG. 1B shows a side view of polishing apparatus 100 prior to initiating a polishing operation and FIG. 1C shows a side view of polishing apparatus 100 during the polishing operation. As will be discussed in greater detail below, apparatus 100 may be used to polish a surface 102 of a substrate 104.

Apparatus 100 includes a polishing pad assembly 110 and a support or chuck 120 mounted over assembly 110. Pad assembly 110 includes a lower pad 112 and an upper pad 114. Upper pad 114 provides an upper abrasive surface 116. The pads 112, 114 normally are configured so that upper pad 114 may be easily replaced when its abrasive surface 116 becomes worn. For convenience of illustration, upper pad 114 is shown separated from lower pad 112, however, the pads 112, 114 are normally in contact and are fixed relative to one another so that the rotation of upper pad 114 can be controlled by controlling the rotation of the lower pad 112. By way of example, polishing pads suitable for implementing pads 112, 114, are commercially available from Rodel of Newark, Del.

Support 120 is configured so that it may securely hold or clamp substrate 104 so that the substrate 104 remains substantially stationary with respect to support 120. Support 120 may be positioned as shown in FIG. 1B so that the surface to be polished 102 is separated from polishing pad assembly 110, and may also be positioned as shown in FIG. 1C so that the surface to be polished 102 is in contact with abrasive surface 116 of upper pad 114.

During a polishing operation, support 120 is movable so that the surface to be polished 102 may be moved into contact with abrasive surface 116 of upper pad 114 (as shown in FIG. 1C). Once the substrate is in contact with pad assembly 110, the pad assembly is rotated in the direction indicated by arrow 122 (shown in FIG. 1A) about axis of rotation 150. Further, support 120 is rotated in the direction indicated by arrow 124 about axis of rotation 152. Axes 150, 152 are both perpendicular to the plane of the page in FIG. 1A.

The rotation of pad assembly 110 and support 120 normally are controlled, for example, by one or more motors (not shown). Pad assembly 110 and support 120 rotate with respect to one another, however, they are normally not translated with respect to one another. Thus, axes 150, 152 remain substantially parallel and stationary with respect to one another. Since support 120 holds substrate 104 substantially stationary with respect to support 120, the rotation of pad assembly 110 and support 120 grinds the surface 102 of substrate 104 against the abrasive surface 116 of upper pad 114. The grinding of surface 102 against abrasive surface 116 polishes surface 102.

Abrasive surface 116 mechanically polishes surface 102. To improve the quality of polishing provided to surface 102, apparatus 100 is normally used in conjunction with a polishing slurry 130 (shown in FIG. 1C). Slurry 130 is normally poured onto the center of upper pad 114. As pad assembly 110 is roated, polishing slurry is distributed by centrifugal force and forms a relatively thin film on the entire abrasive surface 116 of upper pad 114. Slurry 130 includes a chemical polishing liquid (e.g., potasium hydroxide or ammonium hydroxide) and an abrasive (e.g., collodial silica or aluminum oxide) that is suspended in the liquid. The abrasive in slurry 130 cooperates with the abrasive surface 116 of upper pad 114 to mechanically polish surface 102. The chemical polishing liquid in which the abrasive is suspended is selected so that it chemically reacts with surface 102, thereby chemically polishing surface 102. Since apparatus 100 provides both mechanical and chemical polishing, the polishing process is referred to as chemical-mechanical-planarization (CMP).

One problem associated with polishing apparatus 100 relates to the distribution of slurry 130. Ideally, the slurry 130 is provided to all portions of the surface to be polished 102. Such a distribution permits an even amount of polishing to be provided to all parts of surface 102. However, polishing apparatus 100, as well as other prior art polishing apparatuses, fail to achieve this objective.

The relative motion of substrate 104 and pad assembly 110 defines a leading edge 140 (shown in FIG. 1C) and a trailing edge 142 of substrate 104. This relative motion causes the slurry 130 to build up in a "wave-front" 132 proximal to the leading edge 140. Some of the slurry 130 in the wave-front 132 penetrates between surface 102 and upper pad 114. However, there is an uneven distribution of the slurry beneath the substrate because more of the slurry reaches the outer edges of surface 102 than the center of surface 102.

FIGS. 2A and 2B illustrate the distribution of slurry across the surface 102 to be polished. FIG. 2A illustrates the distribution of slurry caused by rotation of pad assembly 110 (in the direction of arrow 122 as shown in FIG. 1A) when substrate 104 (and support 120) remains stationary and does not rotate. Under these conditions, a dashed line 210 represents a boundary between the portions of surface 102 that are wetted by the slurry and the portion that is not. Accordingly, the wetted portion is at 212 and the non-wetted portion is at 214. Specifically, the slurry wets the region 212 between the leading edge 140 of surface 102 and dashed line 210, however, the slurry does not reach the non-wetted region 214 to the right of dashed line 210 to the trailing edge 142.

FIG. 2B illustrates the distribution of slurry achieved when substrate 104 is rotated (in the direction of arrow 124 as shown in FIG. 1A) in addition to the rotation of pad assembly 110. In FIG. 2B, a dashed circle 220 represents the boundary between a wetted portion 222 and a non-wetted portion 224 of surface 102. As shown by FIG. 2B, rotation of surface 102 improves the distribution of slurry, however, a central region 224 remains essentially non-wetted with little or no slurry. So while the outer edge region 222 receives chemical and mechanical polishing, the central region 224 essentially receives only the mechanical polishing, or dry polishing, provided by the abrasive surface 116 of upper pad 114. Chemical polishing is normally a faster process than mechanical polishing. Apparatus 100 therefore tends to polish, due to the uneven distribution of slurry, the outer edge region 222 faster than the central region 224. The type of polishing provided by apparatus 100 is often referred to as being "edge-fast". Rather than being perfectly planar, after polishing by apparatus 100, surface 102 tends to be somewhat concave with region 224 bulging outward slightly rather than be planar with region 222.

Those skilled in the art will appreciate that the location and size of the central, non-wetted, region 224 are determined by several factors including, for example, the pressure between surface 102 and abrasive surface 116, the type of abrasive used in surface 116, the type of slurry used, the relative speeds of surface 102 and pad assembly 110, and, perhaps most importantly, the size of the surface to be polished 102. The tendency for the slurry to fail to wet the central region 224 increases with increases in the size of the surface to be polished.

Another factor that tends to make prior art polishing apparatus 100 provide an "edge fast" type of polish relates to the relative speeds of the central and outer portions of the surface to be polished 102. Referring to FIG. 1A, when support 120 is rotating about axis 152, the linear velocity of support 120 at the axis of rotation 152 is zero and this linear velocity increases as the distance from the axis of rotation 152 increases. As such, the outer portions of surface 102 move faster relative to the abrasive surface 116 than does the center of surface 102. This disparity in velocities also tends to provide a faster polishing to the edges of surface 102, thereby compounding the problems associated with the uneven distribution of slurry discussed above.

Both of the problems discussed above that contribute to making prior art polishing methods be "edge fast" become exacerbated by increases in the size of the surface to be polished 102. Therefore, although conventional polishing apparatus and techniques are satisfactory for providing CMP to semiconductor surfaces approximately eight inches in diameter these apparatuses and techniques have proven unsatisfactory for polishing or planarizing larger surfaces greater than eight inches. This is particularly true for polishing semiconductor surfaces larger than about fourteen inches in diameter.

One prior art method for improving the distribution of slurry 130 between surface 102 of substrate 104 and abrasive surface 116 is to provide micro-channels or perforations in the upper pad 114. However, such channels or perforations can cause breakage or scratching of the surface 102 to be polished.

Advances in the semiconductor industry continually lead to increases in the size of the wafers and chips being produced. There is therefore a need for apparatuses and methods for polishing relatively large semiconductor surfaces and other surfaces, particularly wafers sizes as large as fourteen inches in diameter.

It is therefore an object of the present invention to provide an improved polishing apparatus and method for polishing relatively large surfaces.

These and other objects of the present invention will be described in detail in the remainder of the specification referring to the drawings.

SUMMARY OF THE INVENTION

The present invention relates to an improved polishing apparatus including a lower pad and an upper pad for use in a CMP process. The upper pad has an upper abrasive surface and the lower pad has an upper surface defining one or more grooves in the lower pad. The upper pad is disposed over the lower pad and channels form at least temporarily in the upper pad abrasive surface over the grooves. These channels improve the distribution of slurry in the polishing apparatus. The upper pad may define a first polishing region and a second polishing region. The total area of channels in the first polishing region is greater than the total area of the channels in the second polishing region.

The present invention is capable of other and different embodiments, and its several details are capable of modifications in various respects, all without departing from the invention.

BRIEF DESCRIPTION OF THE FIGURES

For a fuller understanding of the nature and objects of the present invention, reference should be made to the following detailed description taken in connection with the accompanying drawings in which the same reference numerals are used to indicate the same or similar parts wherein.

DETAILED DESCRIPTION OF THE PREFERRED EMBODIMENTS

Figure 1A:
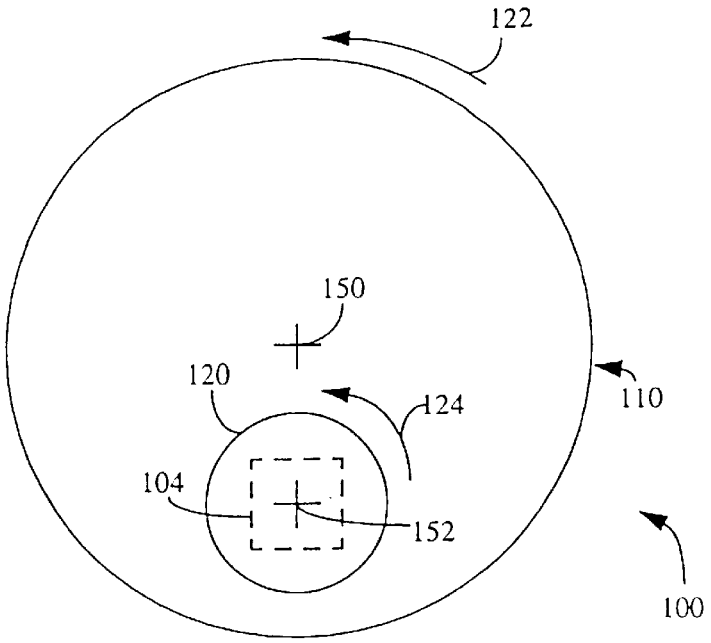
PRIOR ART FIG. 1A
FIG. 1A shows a top view of a prior art polishing apparatus.
Figure 1B:
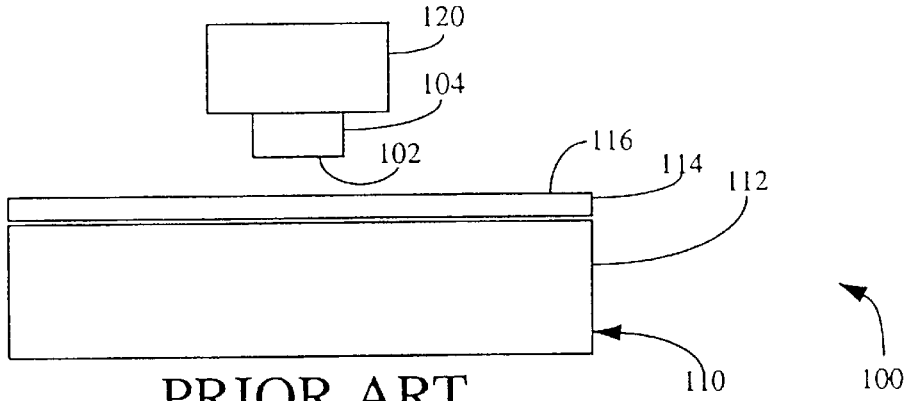
PRIOR ART FIG. 1B
FIGS. 1B and 1C show side views of the apparatus shown in FIG. 1A before and during a polishing operation, respectively.
Figure 1C:
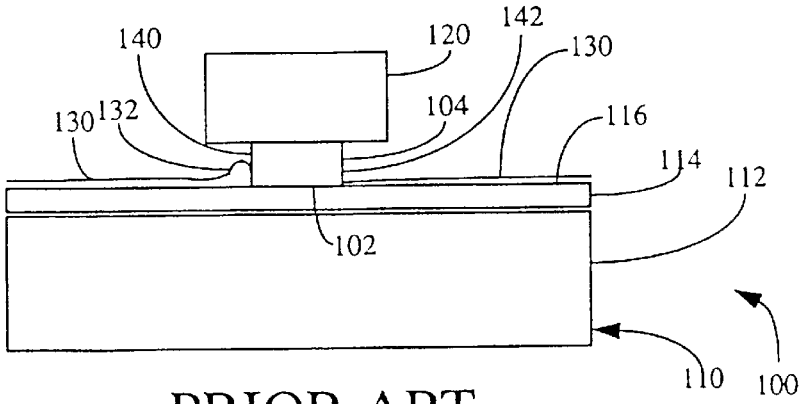
PRIOR ART FIG. 1C
Figure 2A:
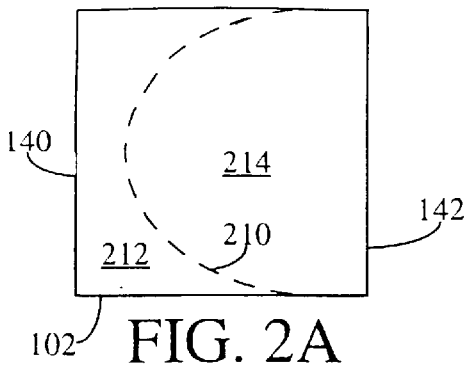
FIG. 2A illustrates the distribution of slurry provided by the apparatus shown in FIG. 1A when the pad assembly is rotated and the support remains stationary.
Figure 2B:
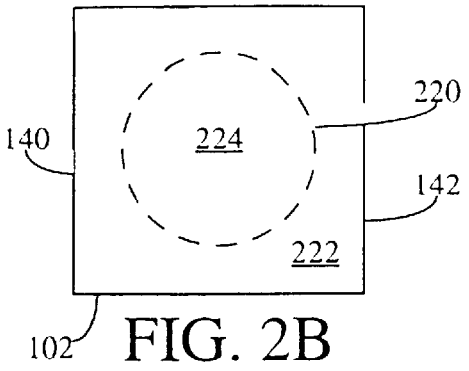
FIG. 2B illustrates the distribution of slurry provided by the apparatus shown in FIG. 1A when both the pad assembly and the support are rotated.
Figure 3A:
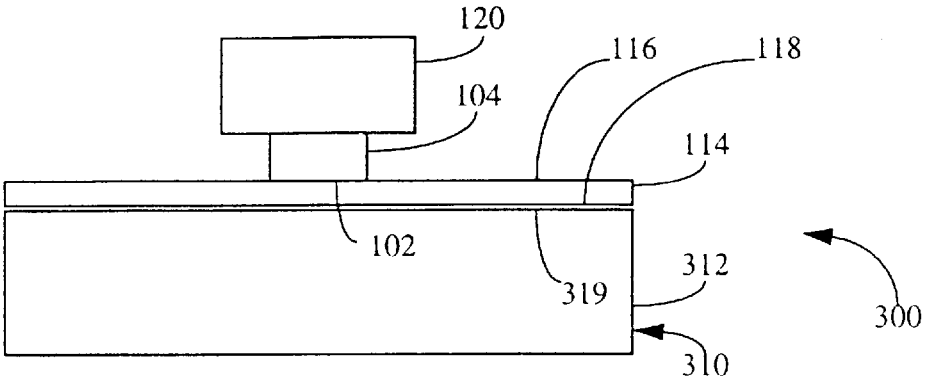
FIG. 3A shows a side view of one embodiment of a polishing apparatus constructed according to the present invention.
Figure 3B:
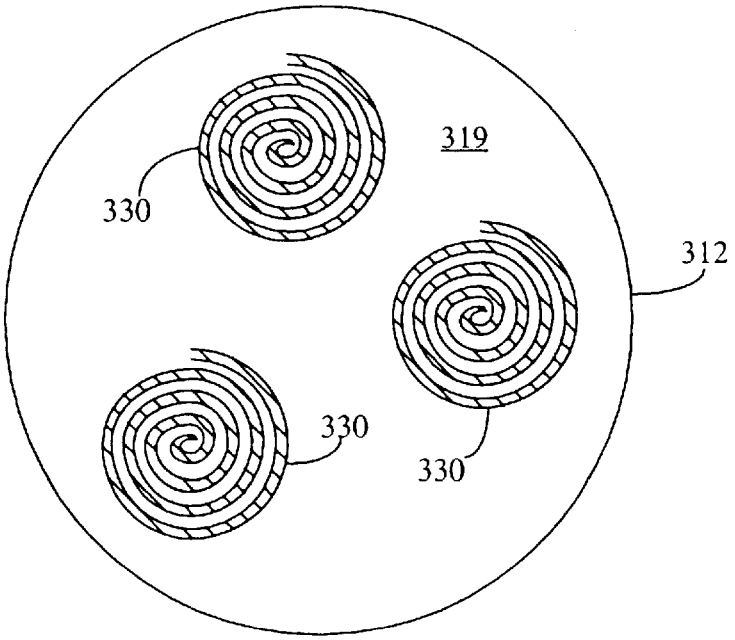
FIG. 3B shows a top view of one embodiment of the lower pad of a polishing apparatus constructed according to the present invention.

FIG. 3A shows a side view of a preferred embodiment of a polishing apparatus 300 constructed according to the present invention. Apparatus 300 has generic elements that are similar to those in prior art apparatus 100, (shown in FIGS. 1A–1C). The major generic elements include support 120, for holding substrate 104, and a pad assembly. However, rather than prior art pad assembly 110, apparatus 300 includes a new pad assembly 310. Pad assembly 310 includes upper pad 114 and an improved lower pad 312 which form a novel combination. FIG. 3B shows a top view of improved lower pad 312.

Referring to FIG. 3B, an upper surface 319 of lower pad 312 defines a plurality of grooves 330. Referring to FIGS. 3A and 3B, the upper surface 319 of lower pad 312 is adjacent a lower surface 118 of upper pad 114. In the illustrated embodiment, three spiral shaped grooves 330 are provided in the upper surface 319 of lower pad 312. As will be discussed subsequently in greater detail below, these grooves 330 effect improved distribution of slurry between the surface 102 to be polished and the abrasive surface 116 of upper pad 114.

Figure 4:
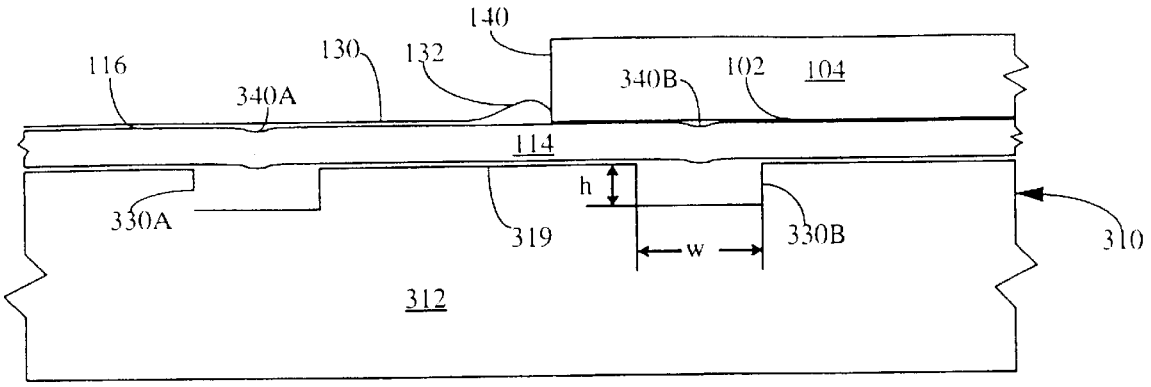
FIG. 4 shows a partial side view of a polishing apparatus constructed according to the present invention that shows two grooves in the lower pad.

FIG. 4 shows an expanded, partial view of apparatus 300 shown in FIGS. 3A and 3B. FIG. 4 shows two adjacent grooves 330A, 330B defined in the upper surface 319 of lower pad 312. These grooves may be part of any of the spiral grooves 330 in FIG. 3B. In the regions of grooves 330A and 330B, lower pad 312 does not support upper pad 114. This lack of support permits portions of upper pad 114 to sink down slightly into the grooves 330A and 330B. This forms depressions or channels 340A and 340B in upper pad 114. Upper pad 114 deforms at least temporarily to form these channels. Downward pressure on upper pad 114 (e.g., from surface 102) and the slurry between the substrate and abrasive surface assist in the formation of channels in the upper pad. One skilled in the art will appreciate that the formation of channels in the upper pad may be induced by any suitable means or force. Each of these channels 340A, 340B acts as a reservoir for holding a small amount of slurry 130.

In operation, when a channel in the upper pad is not disposed under substrate 104, (e.g., a channel in the position of channel 340A as shown in FIG. 4), the channel tends to fill with slurry. When rotation of the pad assembly 110 moves the channel under the substrate 104 (e.g., a channel in the position of channel 340B as shown in FIG. 4), the channel tends to carry a small amount of the slurry 130 between the surface to be polished 102 and the abrasive surface 116. The channels 340A, 340B provide for the distribution of slurry along the surface 102 to be polished which is not provided for by the prior art.

Figure 5:
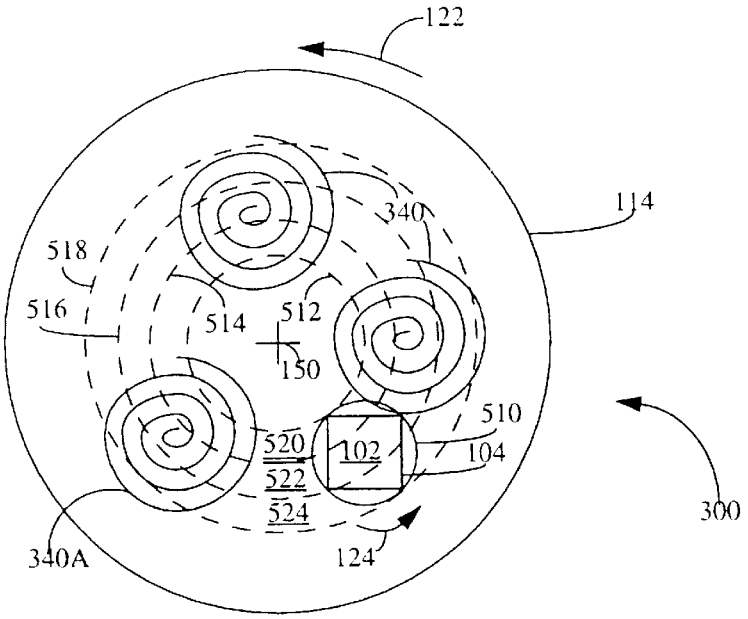
FIG. 5 shows a top view of a polishing apparatus constructed according to the present invention using the lower pad shown in FIG. 3B.

FIG. 5 shows a top view of apparatus 300 showing the channels 340 formed in the abrasive surface of upper pad 114 due to the presence of the grooves in the upper surface of the lower pad. FIG. 5 also shows the spatial relationship between the channels 340 and the surface to be polished 102. For convenience of illustration, the support 120 that holds substrate 104 is not shown in FIG. 5.

In operation, pad assembly 310, which includes upper pad 114 and lower pad 312, rotates about the axis of rotation 150 in the direction indicated by arrow 122 and substrate 104 rotates about the axis of rotation 152 (not shown) in the direction indicated by arrow 124. The slurry is added to the center of pad 114 at or near axis 150. The centrifugal force caused by the rotation pad assembly 310 in direction of arrow 122 distributes the slurry across the top of upper pad 114. The channels 340 act as reservoirs holding small amounts of the slurry. When the rotation of pad 114 moves the channels 340 under the surface to be polished 102, the channels 340 carry the slurry under the surface 102, thereby ensuring that the entire surface 102 is wetted with the slurry rather than just the outer edge region as was done in prior art systems.

Again referring to FIG. 5, the illustrated spiral pattern of channels carries more slurry to the central region of surface 102 than to the outer edge region of surface 102. This is due to the spiral pattern of grooves, each spiral groove decreasing in diameter near its center. This may be understood by examining the portions of the pad 114 that actually contact, or polish, the surface 102.

Rotation of substrate 104 causes surface to be polished 102 to sweep out an area that is bounded by circle 510 (i.e., when support 120 rotates about axis 152, no part of surface 102 extends beyond circle 510). The rotation of pad 114 causes an annular region of pad 114 to contact, and thereby polish, surface 102. This annular region is illustrated by four concentric dashed circles 512, 514, 516, 518. Each of these circles are centered about the axis of rotation 150 of pad assembly 310. The innermost circle 512 tangentially intersects the inner portion of circle 510 and the outermost circle 518 tangentially intersects the outer portion of circle 510. Circles 512 and 518 bound an annular region that may be referred to as the polishing region. This polishing region is the only part of pad 114 that contacts surface 102. The middle two circles 514, 516 subdivide the polishing region into three annular sub-regions which are referred to as an inner polishing region 520, a central polishing region 522, and an outer polishing region 524. The inner polishing region 520 is bounded by dashed circles 512 and 514, the central polishing region 522 is bounded by dashed circles 514 and 516, and the outer polishing region 524 is bounded by dashed circles 516 and 518. The union of the three annular regions 520, 522, and 524 defines the entire polishing region.

As shown in FIG. 5, the central polishing region 522 intersects channels 340 more times than the inner or outer polishing regions 520, 524. For example, the central polishing region 522 intersects the channel 340A seven times, while the inner polishing region 520 intersects the channel 340A only six times and the outer polishing region 524 intersects the channel 340A only five times. This is because of the spiral shape of the channels. Each time a portion of surface 102 intersects or crosses a channel 340, that portion of the surface 102 is exposed to the slurry 130. So increased intersections with the channels 340 provides for increased wetting of the surface with slurry. (Recall that the channels are continually filled with slurry because slurry is poured onto the center of upper pad 114 and centrafugal force distributes the slurry across the upper surface of pad 114.)

The total area (e.g., measured in square meters) of the channels 340 disposed in the central polishing region 522 is greater than the total area of the channels 340 disposed in the inner polishing region 520 and is also greater than the total area of the channels 340 disposed in the outer polishing region 524. The increased area of the channels 340 disposed in the central polishing region 522 exposes the portion of the surface 102 that is in contact with the central polishing region to an increased amount of slurry, thereby increasing the wetting of the central area.

The rotation of surface 102 moves the outer edges of surface 102 into and out of all three polishing regions 520, 522, and 524. However, substrate 104 is positioned with regard to upper pad 114 so that a central portion of surface 102 always remains in contact with the central polishing region 522. Since the center of surface 102 is always in contact with the central polishing region 522 and the outer edges of surface 102 are only intermittently in contact with the central polishing region 522, the spiral pattern of channels provides increased slurry to the central portion of surface 102.

Those skilled in the art will appreciate that the illustrated inner, central, and outer polishing regions 520, 522, and 524 are drawn to illustrate the operation of the present invention to increase slurry delivery to the central regions of the surface to be polished 102. The polishing region may be divided up differently into a greater or lesser member of regions. In all cases, however, regions closer to the center of surface 102 will always receive an increased amount of slurry.

Figure 6:
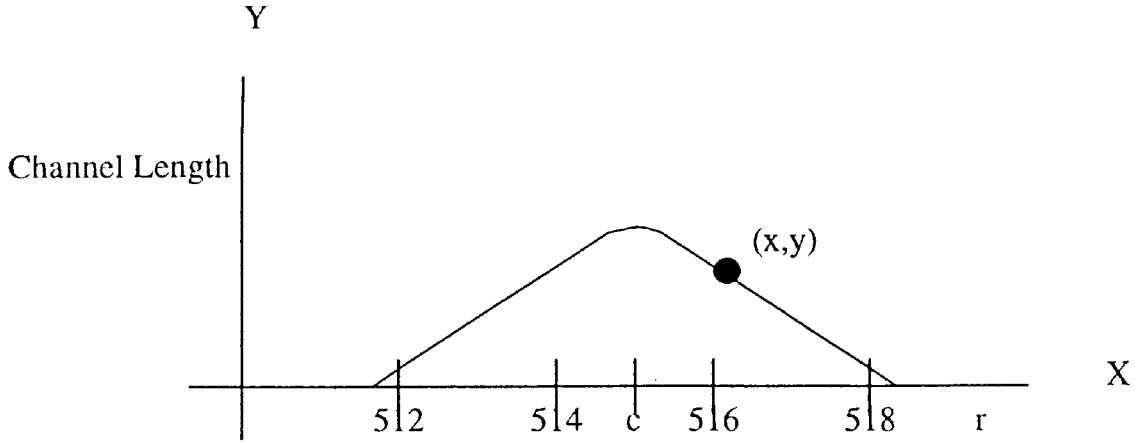
FIG. 6 shows a graph of a radial distribution of the channels in the polishing region of the embodiment shown in FIG. 5.

FIG. 6 shows a graph that illustrates the distribution of slurry that the spiral pattern of channels shown in FIG. 5 provide. In FIG. 6, the X-axis represents the radius of a circle centered on the axis of rotation 150 and inscribed on the abrasive upper surface 116 of upper pad 114, and the Y-axis represents the total length of the channel intersections in that circle. Each point (x,y) in the curve shown in FIG. 6 illustrates the total length y of the intersections with the channels 340 that is included in a circle of radius x that is centered about the center of rotation 150. For example, FIG. 7 shows a circle 710 of radius x that is centered about the axis of rotation 150 and is inscribed in the abrasive surface 116.

Figure 7:
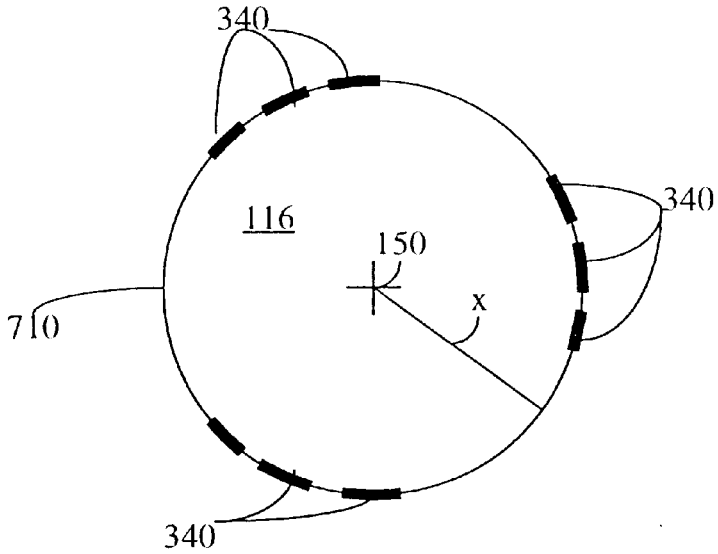
FIG. 7 illustrates how a single data point of the curve shown in FIG. 6 is calculated.

Referring to FIG. 7, the darkened portions of circle 710 represent intersections with the spiral channels 340. These darkened portions of circle 710 are merely representative of channel intersections and are not meant to correspond directly to the channels illustrated in FIG. 5. The value y in the curve shown in FIG. 6 represents the length of these intersections. So the graph shown in FIG. 6 represents the distribution of channel length intersections at a given radius "r." This distribution may be more conveniently referred to as a radial distribution of channels.

As shown in FIG. 6, the maximum length of channel intersections is at the circle of radius 'c'. The value of 'c' preferably is selected in conjunction with the positioning of the surface to be polished 102 so that the circle of radius c passes through the center of the surface to be polished 102. Since increased channel length intersections provides an increased amount of slurry, the maximum amount of slurry is provided to the center of the surface to be polished 102.

The distribution shown in FIG. 6 is characterized by a "bell" shape curve (and may be for example a Gaussian type distribution) that is centered about the center of the surface 102 to be polished. So, the maximum amount of slurry is provided to the center of the surface to be polished and decreasing amounts of slurry are provided to parts of the surface to be polished that are displaced increasingly away from the center. An advantage of the spiral pattern of grooves in the preferred embodiment is that the spiral may easily be adjusted to selectively adjust the parameters of the distribution shown in FIG. 6. That is, by adjusting the tightness of the spiral grooves, the parameters (e.g., the mean value and the standard deviation) of the distribution may be selectively adjusted.

The ability of the present invention to selectively control the amount of slurry delivered to different portions of the surface 102 to be polished overcomes the problems with prior art polishing apparatus 100 and permits an apparatus such as apparatus 300, to provide an even polishing that is not "edge fast" for the various reasons stated previously.

In one preferred embodiment, the lower pad 312 is implemented by cutting three spiral grooves in the upper surface of a Suba IV pad commercially available from Rodel. The diameter of this pad is approximately forty-eight inches. Each of the spiral grooves has a diameter of approximately eight to twelve inches, and each of the spirals are configured so that a straight line segment drawn from the center of a spiral to the exterior of the spiral crosses a maximum of six channels and a minimum of two channels. Each groove has a substantially rectangular cross section, as shown in FIG. 4, with a width "w" of approximately one-quarter (¼) of an inch, and a height "h" of approximately one-sixteenth (1/16) of an inch. The upper pad is implemented using a IC60 pad commercially available from Rodel, and the channels formed, at least temporarily, in the upper pad due to the grooves in the lower pad are approximately one-sixteenth (1/16) of an inch wide and one-thirtysecond (1/32) of an inch high. This embodiment may be used to provide CMP to semiconductor surfaces that are approximately fourteen inches in diameter, and even to larger surfaces.

Spiral shaped grooves 330 are preferred for use in the present invention, because the spiral pattern provides a radial distribution of slurry that is according to a bell curve as illustrated in FIG. 6. Moreover, the spiral pattern can be adjusted easily to selectively control the distribution parameters. However, the inventors contemplated that other groove patterns may be used to provide the same or similar distribution of slurry which are within the scope of the present invention.

Figure 8A:
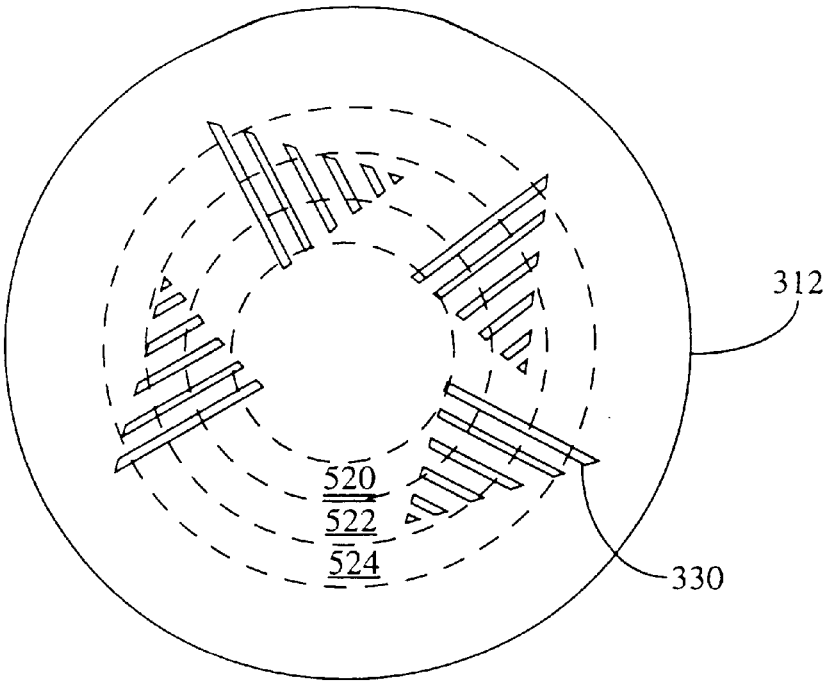
FIGS. 8A and 8B show top views of two alternative embodiments of lower pads constructed according to the present invention.
Figure 8B:
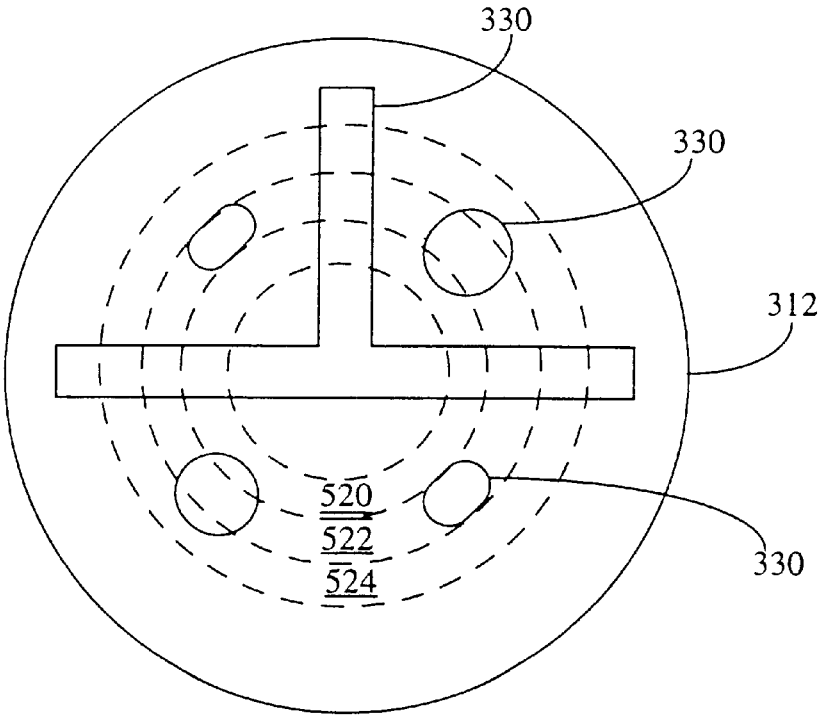

FIGS. 8A and 8B each illustrate alternate embodiments of grooves patterns 330 that may be provided in lower pad 312. Each of these patterns provides a bell curve distribution of slurry.

Figure 9A:
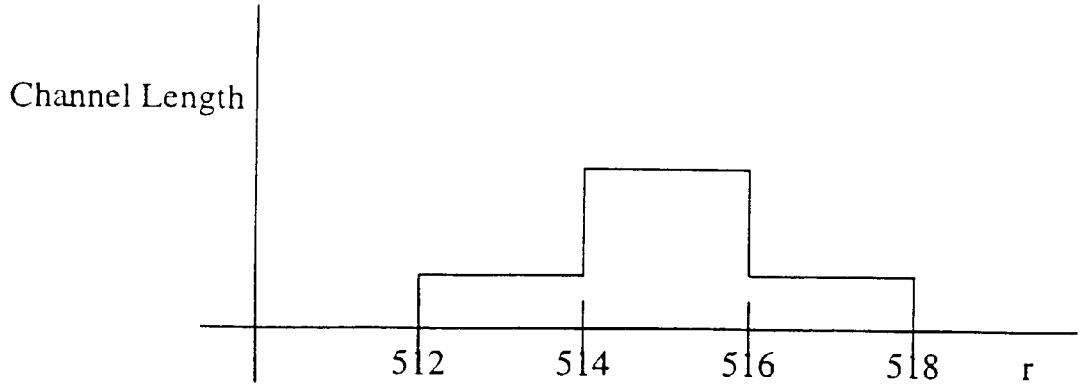
FIGS. 9A, 9B, and 9C show radial distributions of channels in polishing regions that may be employed in embodiments of the present invention shown in FIGS. 10A, 10B, and 10C, respectively.
Figure 9B:
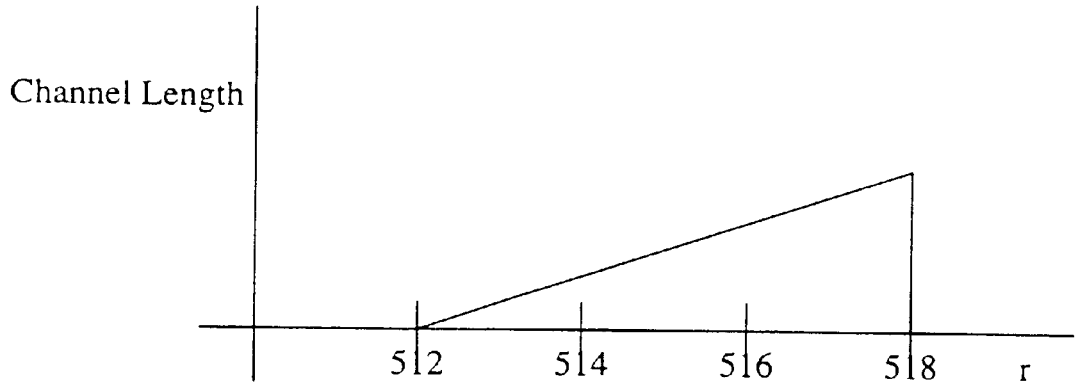
Figure 9C:
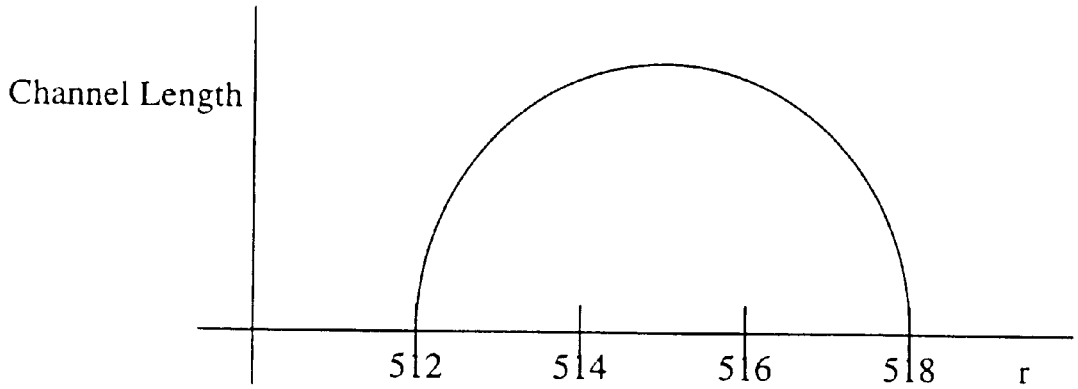
Figure 10A:
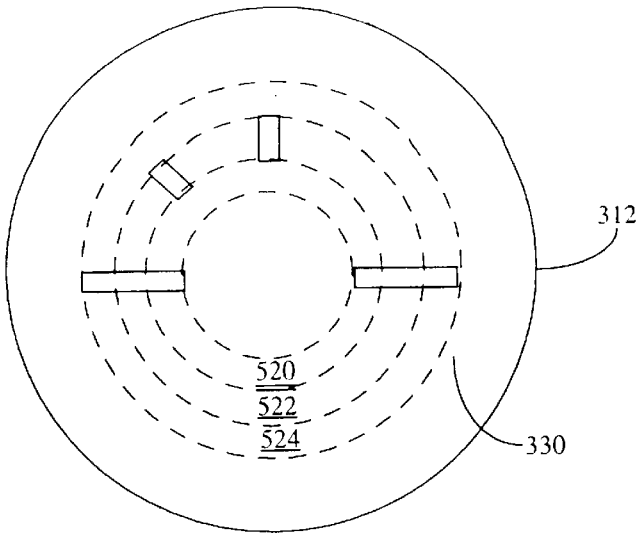
Figure 10B:
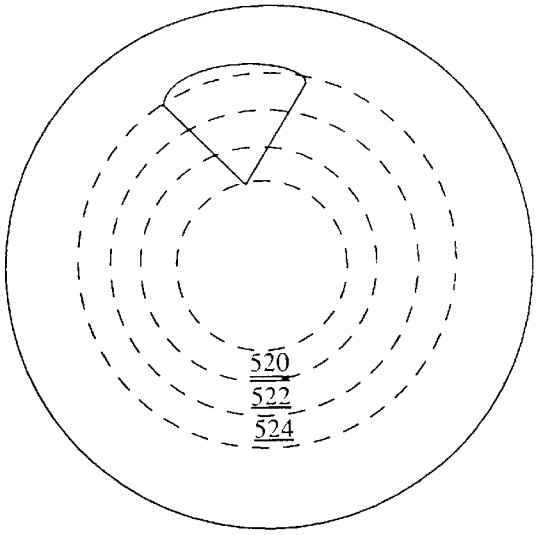
Figure 10C:
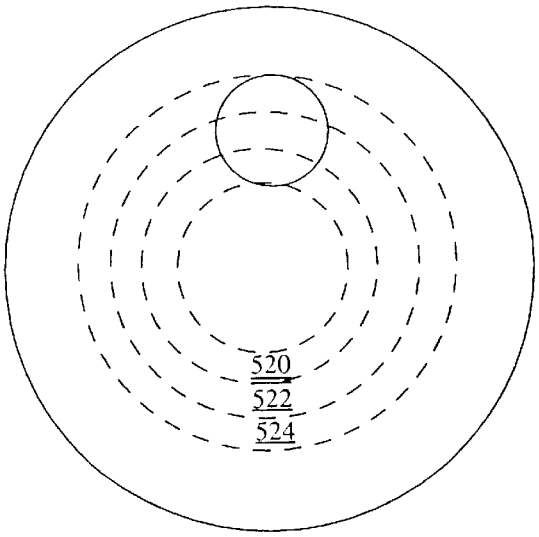

Up to this point, the present invention has been discussed in connection with groove patterns in the upper surface of the lower pad which generate channel patterns in the abrasive surface that are characterized by bell curve distributions of slurry. However, those skilled in the art will appreciate that the present invention will embrace other types of groove patterns and distributions as well. For example, the present invention may be used to provide channel patterns in the abrasive surface that have shapes that result in the distributions shown in FIGS. 9A–9C. A pattern of grooves in the lower pad that produces in the distribution shown in FIG. 9A is shown in FIG. 10A; a pattern of grooves in the lower pad that produces in the distribution shown in FIG. 9B is shown in FIG. 10B; and pattern of grooves in the lower pad that produces in the distribution shown in FIG. 9C is shown in FIG. 10C. As those skilled in the art will appreciate, such distributions may be useful in various polishing contexts, and such channel patterns, as well as groove patterns used to generate such channel patterns, are embraced within the present invention. Further, all radial distributions of channels thus far discussed have been non-uniform however, the invention also embraces channel patterns in the abrasive surface that are characterized by uniform radial channel distributions.

FIG. 4 illustrated each groove in the lower pad as having a rectangular cross section. Those skilled in the art will appreciate that the shape of this cross section is not a limitation of the present invention. Rather, lower pads 312 may be constructed according to the invention with grooves having cross-sections characterized by any shape other shapes, i.e., triangular or circular.

With regard to embodiments thus far discussed, the polishing regions of the upper pad abrasive surface have been characterized by an annular shape. However, the present invention also embraces apparatus defining non-annular polishing regions. For example, in the embodiments thus far discussed, the axis 152 of support 120 essentially always remains stationary with respect to the axis 150 of the pad assembly 310, and this causes the region of the pad that contacts surface 102 to have an annular shape. However, in other embodiments, support 120 may move radially with respect to pad assembly 110 to generate non-annular shaped polishing regions.

Further, in embodiments thus far discussed, the pad assembly uses rotational motion to polish surface 102. In other embodiments, it is contemplated that the pad assembly may use a linear type motion to polish surface 102. In these embodiments, the polishing regions need not be annular.

In yet another embodiment, a polishing liquid rather than a slurry may be used with polishing apparatus constructed according to the present invention. This polishing liquid will not include abrasives in suspension.

Polishing apparatus constructed according to the present invention may be used to polish, or to provide CMP, to semiconductor surfaces as well as to other types of surfaces. Polishing apparatus constructed according to the present invention are particularly useful for polishing relatively large semiconductor surfaces above eight inches in dimension.

Since certain changes may be made in the above apparatus without departing from the scope of the invention herein involved, it is intended that all matter contained in the above description or shown in the accompanying drawing shall be interpreted in an illustrative and not a limiting sense.

What is claimed is:

1. A method of polishing a surface to be polished comprising the steps of:

providing a pad assembly including a lower pad and an upper pad, said upper pad having an abrasive surface and a lower surface, said abrasive surface defining a generally annular polishing region extending circumferentially around a center point, said lower pad having an upper surface, said upper pad being disposed over said lower pad, said lower pad upper surface defining one or more grooves at least partially disposed under said polishing region, a circle centered about the center point and extending through said polishing region forming intersections with some of said one or more grooves where said circle overlaps some of said one or more grooves, a length of the intersections varying according to a radius of the circle, the length of the intersections monotonically increasing from a first value to a second value as the radius of the circle increases from a first radius to a second radius, the length of the intersections monotonically decreasing from the second value to a third value as the radius of the circle increases from the second radius to a third radius, the first radius defining an inner boundary of the polishing region, the third radius defining an outer boundary of the polishing region, the second radius defining a circle near a middle of the polishing region, said upper pad defining at least temporarily one or more channels, at least a portion of said one or more channels being formed over said one or more grooves;

holding said surface to be polished adjacent said abrasive surface; and rotating said pad assembly.

2. A method according to claim 1, further including a step of introducing a slurry to at least a portion of said abrasive surface, said slurry including a polishing liquid and an abrasive, said polishing liquid being chemically reactive with said surface to be polished.

3. A method according to claim 1, further including a step of introducing a polishing liquid to at least a portion of said abrasive surface, said polishing liquid being chemically reactive with said surface to be polished.

4. A method according to claim 1, further including a step of rotating said surface to be polished.

5. A method of polishing a surface to be polished comprising the steps of:

providing a pad assembly including a monolithic lower pad and an upper pad, said upper pad having an abrasive surface and a lower surface, said abrasive surface defining a polishing region, said lower pad having an upper surface, said upper pad being disposed over said lower pad, said lower pad upper surface defining one or more grooves at least partially disposed under said polishing region, said upper pad defining at least temporarily one or more channels, at least a portion of said one or more channels being formed over said one or more grooves; holding said surface to be polished adjacent said abrasive surface; and rotating said pad assembly.

6. A polishing apparatus comprising a lower pad and an upper pad disposed over said lower pad, said upper pad having an abrasive surface and a lower surface, said abrasive surface defining a generally annular polishing region extending circumferentially around a center point, said lower pad having an upper surface, said upper pad lower surface being disposed proximal said lower pad upper surface, said lower pad upper surface defining one or more grooves at least partially disposed under said polishing region, a circle centered about the center point and extending through said polishing region forming intersections with some of said one or more grooves where said circle overlaps some of said one or more grooves, a length of the intersections varying according to a radius of the circle, the length of the intersections monotonically increasing from a first value to a second value as the radius of the circle increases from a first radius to a second radius, the length of the intersections monotonically decreasing from the second value to a third value as the radius of the circle increases from the second radius to a third radius, the first radius defining an inner boundary of the polishing region, the third radius defining an outer boundary of the polishing region, the second radius defining a circle near a middle of the polishing region.

7. An apparatus according to claim 6, said upper pad abrasive surface defining at least temporarily one or more channels, at least a portion of said one or more channels being formed over said one or more grooves.

8. An apparatus according to claim 7, said polishing region including one or more intersections with said one or more channels, when formed.

9. An apparatus according to claim 7, said polishing region including a first polishing region and a second polishing region, said first and second polishing regions being generally annular and concentric with said polishing region and having substantially the same width as each other, said first and second polishing regions including one or more intersections with said one or more channels, when formed, the total area of said one or more intersections with said one or more channels in said second polishing region being greater than the total area of said one or more intersections with said one or more channels in said first polishing region.

10. An apparatus according to claim 9, said first and second polishing regions being non-overlapping.

11. An apparatus according to claim 10, said polishing region having an inner radius r1 and an outer radius r2, said second polishing region overlapping the radius r3, where r3=(r1+r2)/2.

12. An apparatus according to claim 9, said polishing region further including a third polishing region, said third polishing region being generally annular and concentric with said polishing region and having substantially the same width as said first and second polishing regions, said first, second and third polishing regions being non-overlapping and said second polishing region being between said first and third polishing regions, said third polishing region including one or more intersections with said one or more channels, when formed, the total area of said one or more intersections with said one or more channels in said second polishing region being greater than the total area of said one or more intersections with said one or more channels in said third polishing region.

13. An apparatus according to claim 12, said polishing region having an inner radius r1 and an outer radius r2, said second polishing region overlapping the radius r3, where r3=(r1+r2)/2.

14. An apparatus according to claim 13, wherein said first, second and third polishing regions are adjacent to each other and the union of said first, second and third polishing regions forms the entirety of said polishing region.

15. An apparatus according to claim 1, said polishing region including a first polishing region and a second polishing region, said first and second polishing regions being generally annular and concentric with said polishing region and having substantially the same width as each other, said one or more grooves being at least partially disposed under said first and second polishing regions, the total area of said one or more grooves disposed under said second polishing region being greater than the total area of said one or more grooves disposed under said first polishing region.

16. An apparatus according to claim 15, said first and second polishing regions being non-overlapping.

17. An apparatus according to claim 16, said polishing region having an inner radius r1 and an outer radius r2, said second polishing region overlapping the radius r3, where r3=(r1+r2)/2.

18. An apparatus according to claim 15, said polishing region further including a third polishing region, said third polishing region being generally annular and concentric with said polishing region and having substantially the same width as said first and second polishing regions, said first, second, and third polishing regions being non-overlapping and said second polishing region being between said first and third polishing regions, said one or more grooves being at least partially disposed under said third polishing region, the total area of said one or more grooves disposed under said second polishing region being greater than the total area of said one or more grooves disposed under said third polishing region.

19. An apparatus according to claim 18, said polishing region having an inner radius r1 and an outer radius r2, said second polishing region overlapping the radius r3, where r3=(r1+r2)/2.

20. An apparatus according to claim 19, wherein said first, second and third polishing regions are adjacent to each other and the union of said first, second and third polishing regions forms the entirety of said polishing region.

21. An apparatus according to claim 1, further including a support for holding a substrate, said substrate having a surface to be polished.

22. An apparatus according to claim 21, said support holding said surface to be polished adjacent to said upper pad abrasive surface where desired.

23. An apparatus according to claim 21, further including means for rotating said support.

24. An apparatus according to claim 21, further including means for rotating said lower and upper pads.

25. An apparatus according to claim 1, at least one of said one or more grooves being characterized by a spiral shape.

26. An apparatus according to claim 1, wherein said lower pad is monolithic.

27. An apparatus according to claim 1, wherein said one or more grooves have a depth less than the thickness of said lower pad.

28. An apparatus according to claim 1, wherein said one or more grooves have a depth of approximately 1/16 inch.

29. An apparatus according to claim 1, said lower pad being sufficiently rigid to remain substantially planar when a surface to be polished is held against said abrasive surface in said polishing region.

30. An apparatus for polishing a surface to be polished, said apparatus comprising:

a pad assembly including a lower pad and an upper pad, said upper pad having an abrasive surface and a lower surface, said abrasive surface defining a generally annular polishing region extending circumferentially around a center point, said lower pad having an upper surface, said upper pad being disposed over said lower pad, said lower pad upper surface defining one or more grooves at least partially disposed under said polishing region, a circle centered about the center point and extending through said polishing region forming intersections with some of said one or more grooves where said circle overlaps some of said one or more grooves, a length of the intersections varying according to a radius of the circle, the length of the intersections monotonically increasing from a first value to a second value as the radius of the circle increases from a first radius to a second radius, the length of the intersections monotonically decreasing from the second value to a third value as the radius of the circle increases from the second radius to a third radius, the first radius defining an inner boundary of the polishing region, the third radius defining an outer boundary of the polishing region, the second radius defining a circle near a middle of the polishing region, said upper pad defining at least temporarily one or more channels, at least a portion of said one or more channels being formed over said one or more grooves; and a clamp for holding said surface to be polished adjacent said top pad abrasive surface.

31. An apparatus according to claim 30, further including:

means for rotating said pad assembly; and means for introducing a slurry to at least a portion of said upper pad abrasive surface, said slurry including a polishing liquid and an abrasive; whereby said one or more channels, when formed, carries a portion of said slurry between said surface to be polished and said abrasive surface.

32. An apparatus according to claim 30, further including:

means for rotating said pad assembly; and means for introducing a polishing liquid to at least a portion of said upper pad abrasive surface;

whereby said one or more channels, when formed, carries a portion of said polishing liquid between said surface to be polished and said abrasive surface.

33. An apparatus according to claim 32, wherein said means for introducing polishing liquid is capable of introducing polishing liquid that is chemically reactive with said surface to be polished.

34. An apparatus according to claim 32, wherein said means for introducing polishing liquid is capable of introducing polishing liquid including an abrasive.

35. An apparatus according to claim 24, at least one of said one or more grooves being characterized by a spiral shape.

36. A polishing apparatus comprising a monolithic lower pad and an upper pad disposed over said lower pad, said upper pad having an abrasive surface and a lower surface, said abrasive surface defining a polishing region, said lower pad having an upper surface, said upper pad lower surface being disposed proximal said lower pad upper surface, said lower pad upper surface including one or more grooves at least partially disposed under said polishing region.

37. An apparatus according to claim 36, said upper pad abrasive surface defining at least temporarily one or more channels, at least a portion of said one or more channels being formed over said one or more grooves.

38. An apparatus according to claim 37, said polishing region being generally annular and including a first polishing region and a second polishing region, said first and second polishing regions being generally annular and concentric with said polishing region and having substantially the same width as each other, said one or more grooves being at least partially disposed under said first and second polishing regions, the total area of said one or more grooves disposed under said second polishing region being greater than the total area of said one or more grooves disposed under said first polishing region.

39. An apparatus according to claim 38, said first and second polishing regions being non-overlapping.

40. An apparatus according to claim 39, said polishing region having an inner radius r1 and an outer radius r2, said second polishing region overlapping the radius r3, where $r3=(r1+r2)/2$.

41. An apparatus according to claim 38, said polishing region further including a third polishing region, said third polishing region being generally annular and concentric with said polishing region and having substantially the same width as said first and second polishing regions, said first, second, and third polishing regions being non-overlapping and said second polishing region being between said first and third polishing regions, said one or more grooves being at least partially disposed under said third polishing region, the total area of said one or more grooves disposed under said second polishing region being greater than the total area of said one or more grooves disposed under said third polishing region.

42. An apparatus according to claim 41, said polishing region having an inner radius r1 and an outer radius r2, said second polishing region overlapping the radius r3, where $r3=(r1+r2)/2$.

43. An apparatus according to claim 42, wherein said first, second, and third polishing regions are adjacent and the union of the first, second and third polishing regions forms the entirety of the polishing region.

44. An apparatus according to claim 36, wherein said one or more grooves have a depth less than the thickness of said lower pad.

45. An apparatus according to claim 36, wherein said one or more grooves have a depth of approximately 1/16 inch.

46. An apparatus according to claim 36, said lower pad being sufficiently rigid to remain substantially planar when a surface to be polished is held against said abrasive surface in said polishing region.

47. An apparatus for polishing a surface to be polished, said apparatus comprising:

a pad assembly including a monolithic lower pad and an upper pad, said upper pad having an abrasive surface and a lower surface, said abrasive surface defining a polishing region, said lower pad having an upper surface, said upper pad being disposed over said lower pad, said lower pad upper surface defining one or more grooves at least partially disposed under said polishing region, said upper pad defining at least temporarily one or more channels, at least a portion of said one or more channels being formed over said one or more grooves; and a clamp for holding said surface to be polished adjacent said upper pad abrasive surface.

48. A polishing apparatus comprising a lower pad and an upper pad disposed over the lower pad, the upper pad having an abrasive surface and a lower surface, the lower pad having an upper surface, an annular region extending around a center point being defined in the lower pad, the lower pad upper surface defining one or more grooves disposed within the annular region, a circle centered about the center point and extending through the annular region being characterized by a parameter, the parameter being substantially equal to a length of intersections between the circle and the one or more grooves, the parameter varying according to a radius of the circle, the parameter increasing from a first value to a second value as the radius of the circle increases from a first radius to a second radius, the parameter decreasing from the second value to a third value as the radius of the circle increases from the second radius to a third radius, the first radius defining an inner boundary of the annular region, the third radius defining an outer boundary of the annular region, the third radius being at least eight inches larger than the first radius, the second radius defining a circle near the center of the annular region.

49. An apparatus according to claim 48, the upper pad abrasive surface defining at least temporarily one or more channels, at least a portion of the one or more channels being formed over the one or more grooves.

50. An apparatus according to claim 48, the one or more grooves including a first groove and a second groove, the first groove being characterized by a spiral shape extending from a central location, the second groove being characterized by a spiral shape extending from a central location, the central locations of the first and second grooves being disposed within the annular region.

51. An apparatus according to claim 48, wherein the first value is substantially equal to zero.

52. An apparatus according to claim 48, wherein the third value is substantially equal to zero.

53. A polishing apparatus comprising a lower pad and an upper pad disposed over the lower pad, the upper pad having an abrasive surface and a lower surface, the lower pad having an upper surface, an annular region extending around a center point being defined in the lower pad, the lower pad upper surface defining a first groove and a second groove, the first groove being characterized by a spiral shape starting from a first central location, the second groove being characterized by a spiral shape starting from a second central location, the second central location being distinct from the first central location, the first and second central locations of the first and second grooves being located within the annular region.

* * * * *